US005448199A

United States Patent [19]

Park

[11] Patent Number: 5,448,199

[45] Date of Patent: Sep. 5, 1995

[54] INTERNAL SUPPLY VOLTAGE GENERATION CIRCUIT

[75] Inventor: Chan-Jong Park, Seoul, Rep. of Korea

[73] Assignee: Samsung Electronics Co., Ltd., Suwon, Rep. of Korea

[21] Appl. No.: 177,354

[22] Filed: Jan. 3, 1994

[30] Foreign Application Priority Data

Dec. 9, 1992 [KR] Rep. of Korea ..... 23717/1992

[51] Int. Cl.[6] ..... G05F 3/02

[52] U.S. Cl. ..... 327/546; 327/525; 327/538; 327/543

[58] Field of Search ..... 327/530, 538, 545, 546, 327/525, 526, 543

[56] References Cited

U.S. PATENT DOCUMENTS 4,543,594 9/1985 Mohsen et al. ..... 307/202.1

5,270,983 12/1993 Wuerts et al. ..... 307/296.5

*Primary Examiner*—Timothy P. Callahan

*Assistant Examiner*—Terry D. Cunningham

*Attorney, Agent, or Firm*—Robert A. Westerlund; Stephen R. Whitt; Charles R. Donohoe

[57] ABSTRACT

An internal supply voltage generation circuit, producing an internal supply voltage during a normal mode of operation and an external supply voltage during a burn-in mode of operation. The circuit including a plurality of fuses, the operation of which establishes the burn-in mode of operation, and controls a variable burn-in voltage level.

7 Claims, 6 Drawing Sheets

INTERNAL SUPPLY VOLTAGE GENERATION CIRCUIT

BACKGROUND OF THE INVENTION

The present invention relates to an internal supply voltage generation circuit for use in semiconductor memory devices, and more particularly to an internal supply voltage generation circuit capable of readily adjusting a burn-in voltage level.

As the cell density in semiconductor memory devices increases, the corresponding size of transistor in each cell must be decreased accordingly. These increasingly small transistors experience significant stress under electric fields induced by high external voltage supplies. Thus, 16 Mbit or greater semiconductor memory devices typically provide an internal supply voltage generation circuit which supplies a voltage at lower levels than external voltage supplies. For example, a typical 16Mbit semiconductor memory device may replace an externally generated 5V supply voltage with a 4V internal supply voltage. Such reductions between external and internal operating voltages become even more pronounced in semiconductor memory devices above 16 Mbits. Thus, high density semiconductor memory devices increasingly require an internal supply voltage generation circuit which can generate a stable internal supply voltage.

FIG. 1 illustrates a conventional internal supply voltage generation circuit disclosed in article entitled "An Experimental 16-Mbit DRAM with Reduced peak-Current Noise" which appeared in the IEEE Journal of Solid-State Circuits, Vol. 24, No. 5, October 1989. The conventional internal supply voltage generation circuit includes a reference voltage generation circuit 10 for generating a reference voltage Vref, a current mirror type differential amplifier comparator 20, an output circuit 30 responsive to the output of comparator 20, an internal supply voltage generator 50 for converting the external supply voltage (ext-$V_{cc}$) into an internal supply voltage (int. $V_{cc}$) in response to the output of the output circuit 30. Additionally, a burn-in voltage control circuit 40 is provided for placing the semiconductor memory device in a burn-in mode, wherein high voltage, such as external supply voltage (ext.$V_{cc}$), is applied to the core circuit to check long term performance of the semiconductor memory device under conditions of high voltage and high temperature.

In operation, the conventional internal supply voltage generation circuit shown in FIG. 1 applies the internal supply voltage (int. $V_{cc}$) to the core circuit of the semiconductor memory device at node N4. If during operation, int. $V_{cc}$ drops due to current consumption in the core circuit, a comparator circuit 50A detects the drop and accordingly lowers the voltage level applied to node N3, such that pull-up transistor 19 is sharply "turned-on" to compensate for the drop in int. $V_{cc}$. The foregoing circuit begins operation upon "power-on" of the semiconductor memory device, and, as shown in FIG. 2, continuously generates int. $V_{cc}$ after ext.$V_{cc}$ reaches a predetermined level.

The burn-in voltage level of the conventional circuit shown in FIG. 1 is determined by the burn-in voltage control circuit 40, and in particular by the number of diode-connected PMOS transistors 11, 12, and 13 connected in series between ext.$V_{cc}$ and node N2. When the need arises to change the burn-in voltage, the number of diode-connected PMOS transistors can typically be increased only by removing a metal line "I" connecting node N1 and node N2. This is accomplished by changing the mask pattern for the semiconductor memory device during manufacturing. In the particular example illustrated in FIG. 1, once metal line I has been removed, the burn-in voltage at N2 becomes (ext.$V_{cc}$−3 $|V_{tp}|$), where $V_{tp}$ is the threshold voltage of each diode-connected PMOS transistor.

The conventional technique of removing metal line I by changing the mask pattern complicates production processing for the semiconductor memory device and increases production costs. These disadvantages become particularly acute for high density semiconductor memory devices having internal supply voltage generation circuits which are required to generate burn-in voltages at various levels.

SUMMARY OF THE INVENTION

It is therefore an object of the present invention to provide and internal supply voltage generation circuit for a semiconductor memory device capable of easily and inexpensively adjusting a burn-in voltage level. It is another object of the present invention to provide an internal supply voltage generation circuit which is capable of readily placing the semiconductor memory device in a burn-in mode of operation.

According to an aspect of the present invention, an internal supply voltage generation device is provided which includes a burn-in voltage control circuit for producing a variable burn-in voltage, the circuit comprising; a plurality of transistors connected in series, and at least one switching element connected in parallel with at least one of the plurality of transistors, such that the burn-in voltage can be varied in accordance with a conductive state of the at least one switching element.

According to another aspect of the present invention an internal supply voltage generation device is provided which comprises; a reference voltage generator for generating a reference voltage, a level conversion circuit receiving the reference voltage, the level conversion circuit generating an output voltage equal to an external supply voltage level when the external supply voltage is below a first predetermined threshold, and generating an output voltage equal to an internal supply voltage when the external supply voltage reaches the first predetermined threshold, an external supply voltage detector having a first fuse and receiving the reference voltage to detect a level of the external supply voltage, an output of the external supply voltage detector being logically inverted when the external supply voltage reaches a second predetermined threshold, wherein the second predetermined threshold can be varied in accordance with operation of the first fuse, a burn-in mode setting circuit having a second fuse and receiving the reference voltage, the burn-in mode setting circuit producing an output voltage which sets a burn-in mode, the level of the output voltage being varied in accordance with operation of the second fuse, a burn-in signal generator for generating a burn-in signal in accordance with the outputs from the external supply voltage detector and the burn-in mode setting circuit, a burn-in voltage control circuit for controlling the voltage output of the level conversion circuit in response to an output from the burn-in signal generator, and, an internal supply voltage output circuit for outputting one of the internal supply voltage and the external supply voltage in accordance with the output from the level conversion circuit.

BRIEF DESCRIPTION OF THE DRAWINGS

The above objects and other advantages of the present invention will become apparent upon review of the following the description which is made with reference to the attached drawings, wherein.

DETAILED DESCRIPTION OF THE PREFERRED EMBODIMENTS

Figure 1:
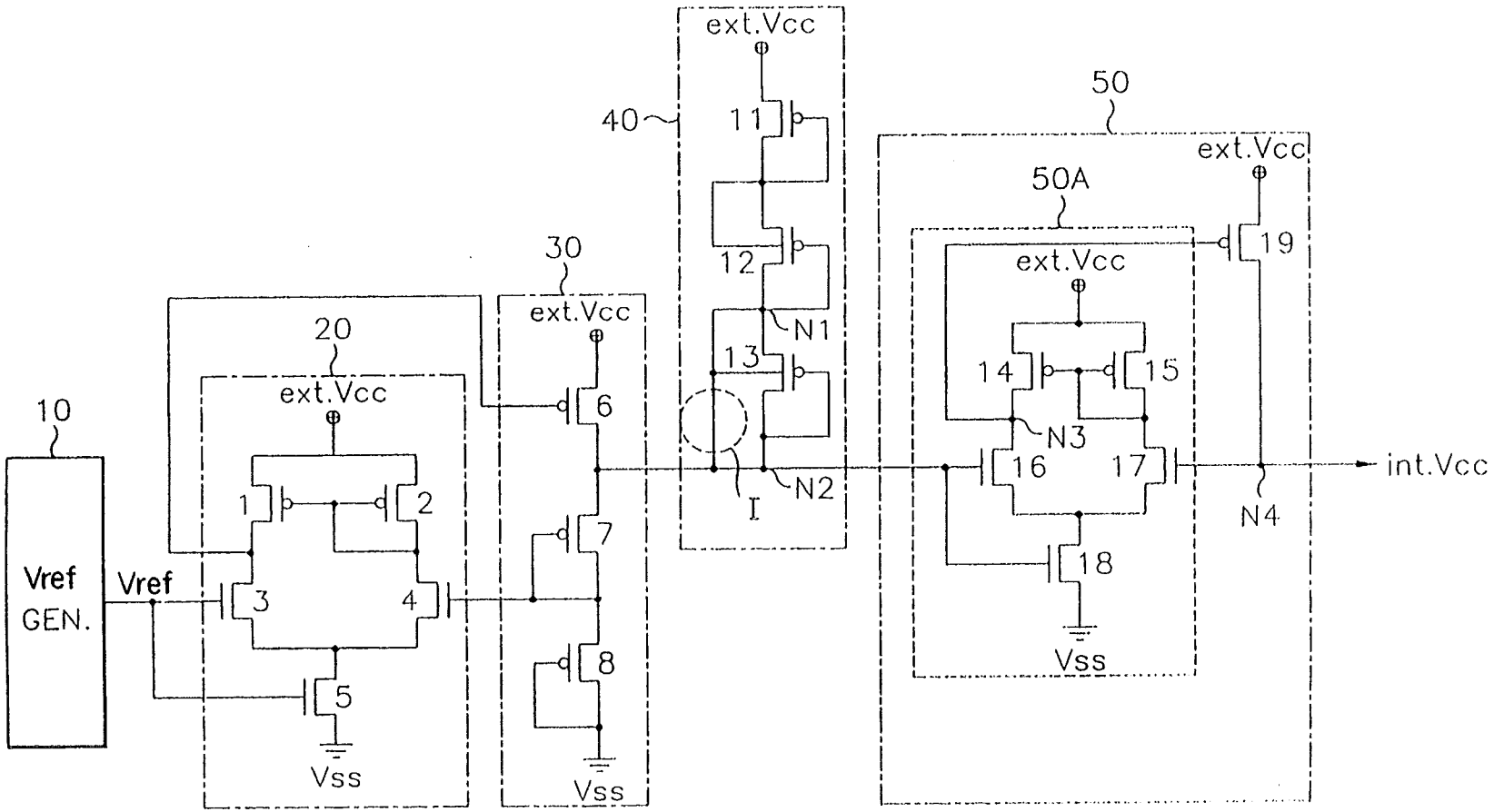
(PRIOR ART) FIG. 1
FIG. 1 shows a conventional internal supply voltage generation circuit.
Figure 2:
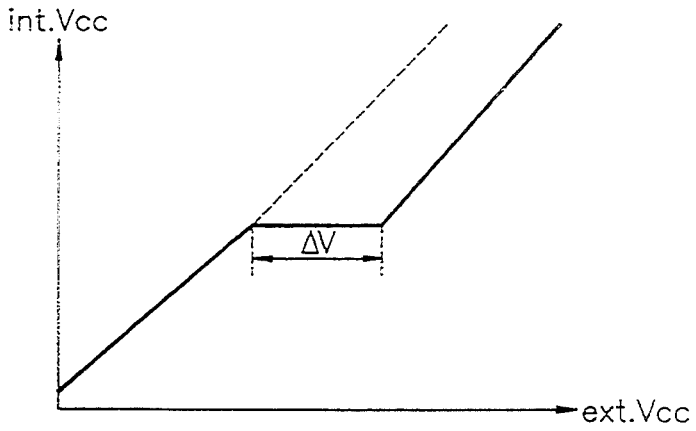
(PRIOR ART) FIG. 2
FIG. 2 shows a output voltage characteristic curve for the conventional internal supply voltage generation circuit shown in FIG. 1.
Figure 3:
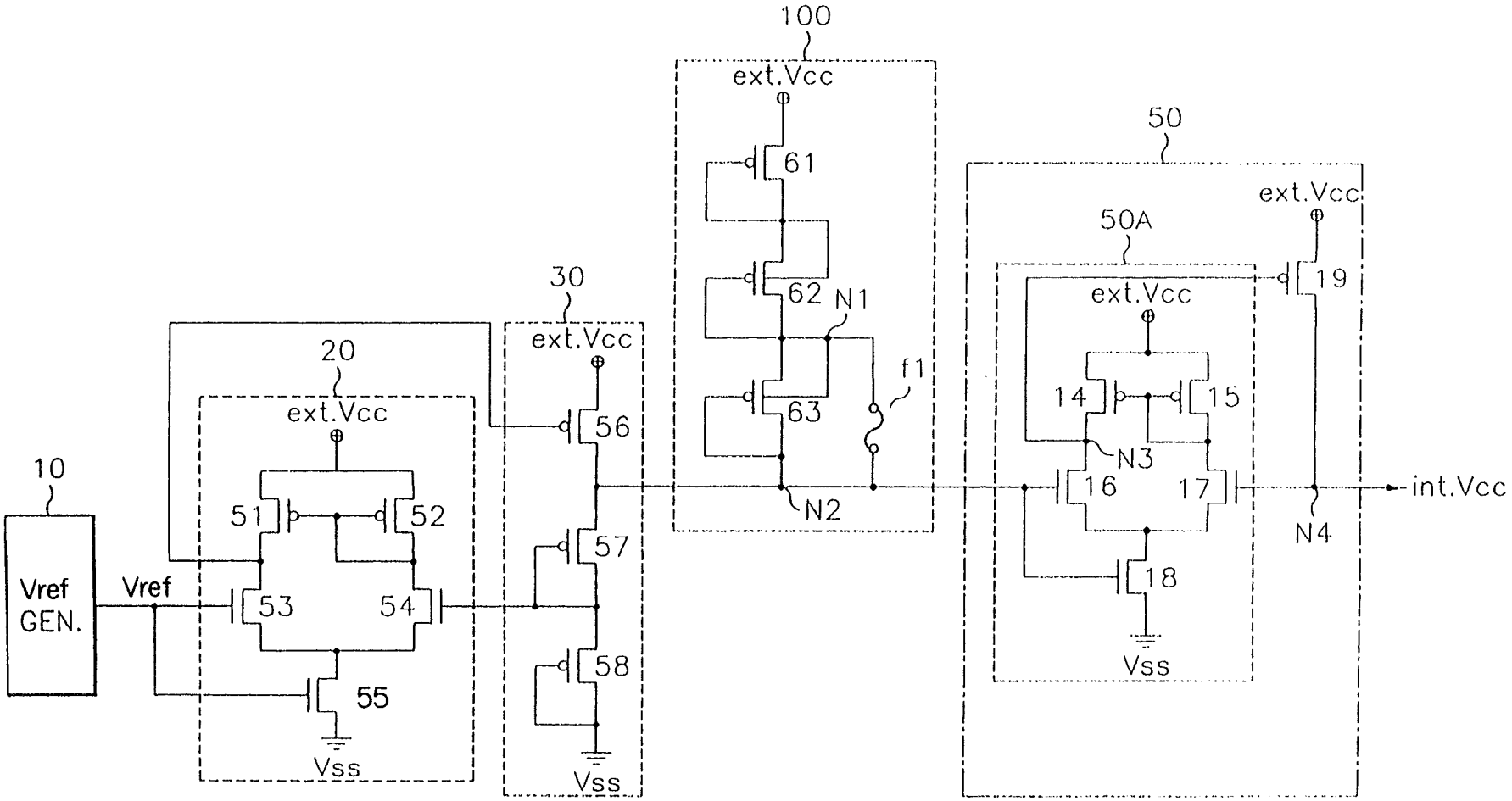
FIG. 3 shows an internal supply voltage generation circuit according to the present invention.

As shown in FIG. 3, a preferred embodiment of the present invention includes reference voltage generation circuit 10, comparator 20, output circuit 30, and internal supply voltage generator 50 of the type generally found in conventional internal supply voltage generation circuits, such as the one shown in FIG. 1. Additionally, the present invention provides burn-in voltage control circuit 100 comprising a series of diode-connected PMOS transistors 61, 62, and 63 connected between ext.$V_{cc}$ and node N2. Naturally, the number and type of the diode-connected transistors actually used in the burn-in voltage control circuit of the invention can be changed from the particular example shown in FIG. 3 to produce any number of desired burn-in voltage levels. For example, if the desired burn-in voltage level were (ext.$V_{cc}-5\,|\,V_{tp}\,|$), then five diode-connected PMOS transistors would be required between ext.$V_{cc}$ and node N2.

The burn-in voltage control circuit 100 of the present invention further comprises a fuse f1 which is placed between nodes N1 and N2 in parallel with transistor 63. Fuse f1 can be readily formed of polysilicon using conventional processing steps. Thus, the burn-in voltage control circuit 100 incorporating fuse f1 can be easily designed and produced.

For the example shown in FIG. 3, a burn-in voltage level of (ext.$V_{cc}-2\,|\,V_{tp}\,|$) is achieved when fuse f1 is left intact. However, a burn-in voltage level of (ext.$V_{cc}-3\,|\,V_{tp}\,|$) can also be easily achieved by opening fuse f1 in the circuit. This is readily accomplished using well-known techniques such as a projecting a laser beam at the fuse. Thus, unlike the conventional internal supply voltage circuit, the present invention provides a means for quickly and efficiently changing the burn-in voltage level.

Figure 4A:
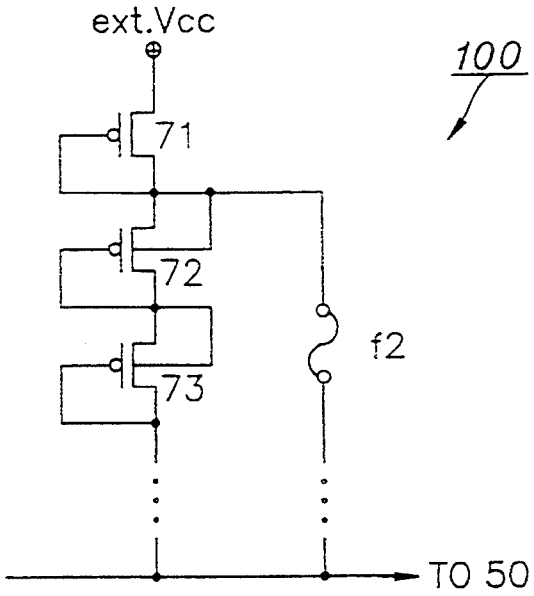
FIGS. 4A and 4B are circuit diagrams of separate preferred embodiments of the burn-in voltage control circuit 100 of the internal supply voltage generation circuit shown in FIG. 3.
Figure 4B:
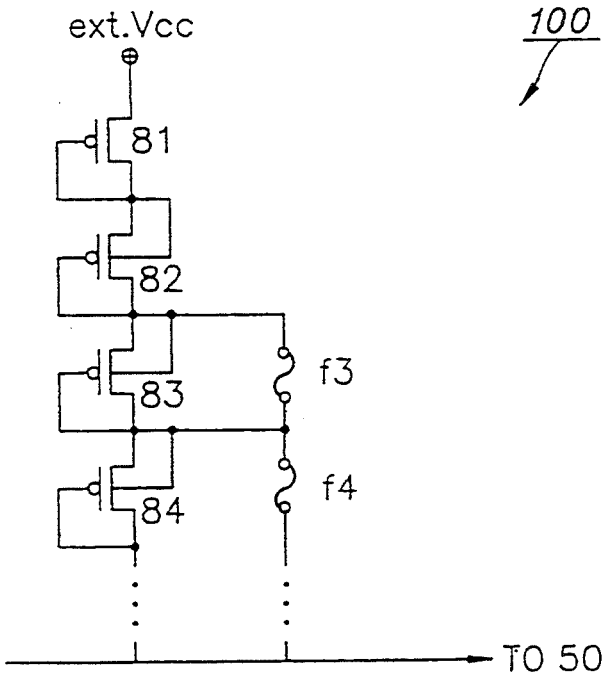

FIGS. 4A and 4B illustrate separate embodiments for the burn-in voltage control circuit 100 of the present invention. In FIG. 4A, fuse f2 is connected in parallel with a series of diode-connected PMOS transistors (72, 73, . . . ) so as to roughly adjust the burn-in voltage level. In FIG. 4B, a plurality of fuses (f3, f4, . . . ) are connected in parallel with respective diode-connected PMOS transistors (83, 84, . . . ), so as to more finely adjust the burn-in voltage level. The arrangements shown in FIGS. 4A and 4B can be combined with, for example, fuse f2 being placed in parallel with the plurality of fuses f3, f4, . . . , to provide for coarse and/or fine adjustment of the burn-in voltage level.

Figure 5:
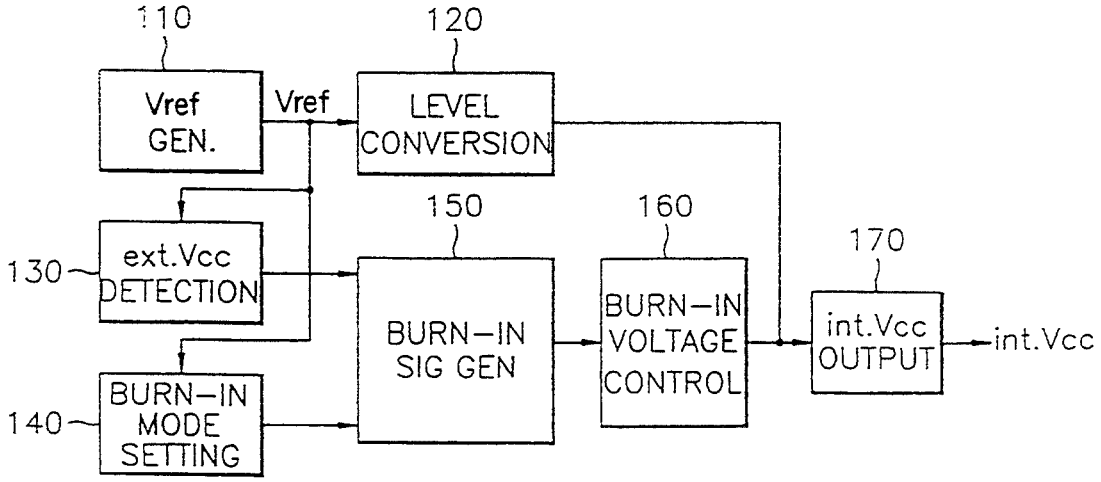
FIG. 5 is a block diagram of an internal supply voltage generation circuit according to another aspect of the present invention.

Additional aspects of the present invention are apparent upon consideration of the block diagram of FIG. 5. The internal supply voltage generation device shown in FIG. 5 includes Vref generator means 110, level conversion means 120 receiving Vref, external supply voltage (ext.$V_{cc}$) detection means 130 for detecting the level of ext.$V_{cc}$, and burn-in mode setting means 140 for placing the semiconductor memory device in a burn-in mode. The device further includes burn-in signal generation means 150 for generating a burn-in signal in response to outputs from the external supply voltage detection means 130 and the burn-in mode setting means 140, burn-in voltage control means 160, responsive to an output of the burn-in signal generation means 150, for controlling the output level of the level conversion means 120, and internal supply voltage output means 170 for generating int.$V_{cc}$ in a normal mode of operation and for generating ext.$V_{cc}$ in a burn-in mode of operation.

In operation, the level conversion means 120 receives Vref and generates ext.$V_{cc}$ when the external supply voltage is below a predetermined threshold. The level conversion means 120 generates a constant int. $V_{cc}$ when the external supply voltage exceeds the predetermined threshold. The predetermined threshold can be varied in accordance with desired design parameters. The burn-in mode setting means 140 produces an output voltage which can be set to a "high" or a "low" level by connecting/disconnecting a fuse contained therein.

The burn-in signal generation means 150 generates a burn-in signal, $\phi$STRB, having a level determined by the output of the external voltage detection means 130 and the burn-in mode setting means 140. The burn-in voltage control means 160 controls the voltage output of the level conversion means 120 in response to the output signal from the burn-in signal generation means 150. The internal supply voltage output means 170 generates ext.$V_{cc}$ or int. $V_{cc}$ in accordance with the output signals of the level conversion means 120 and the burn-in voltage control means 160.

Figure 6:
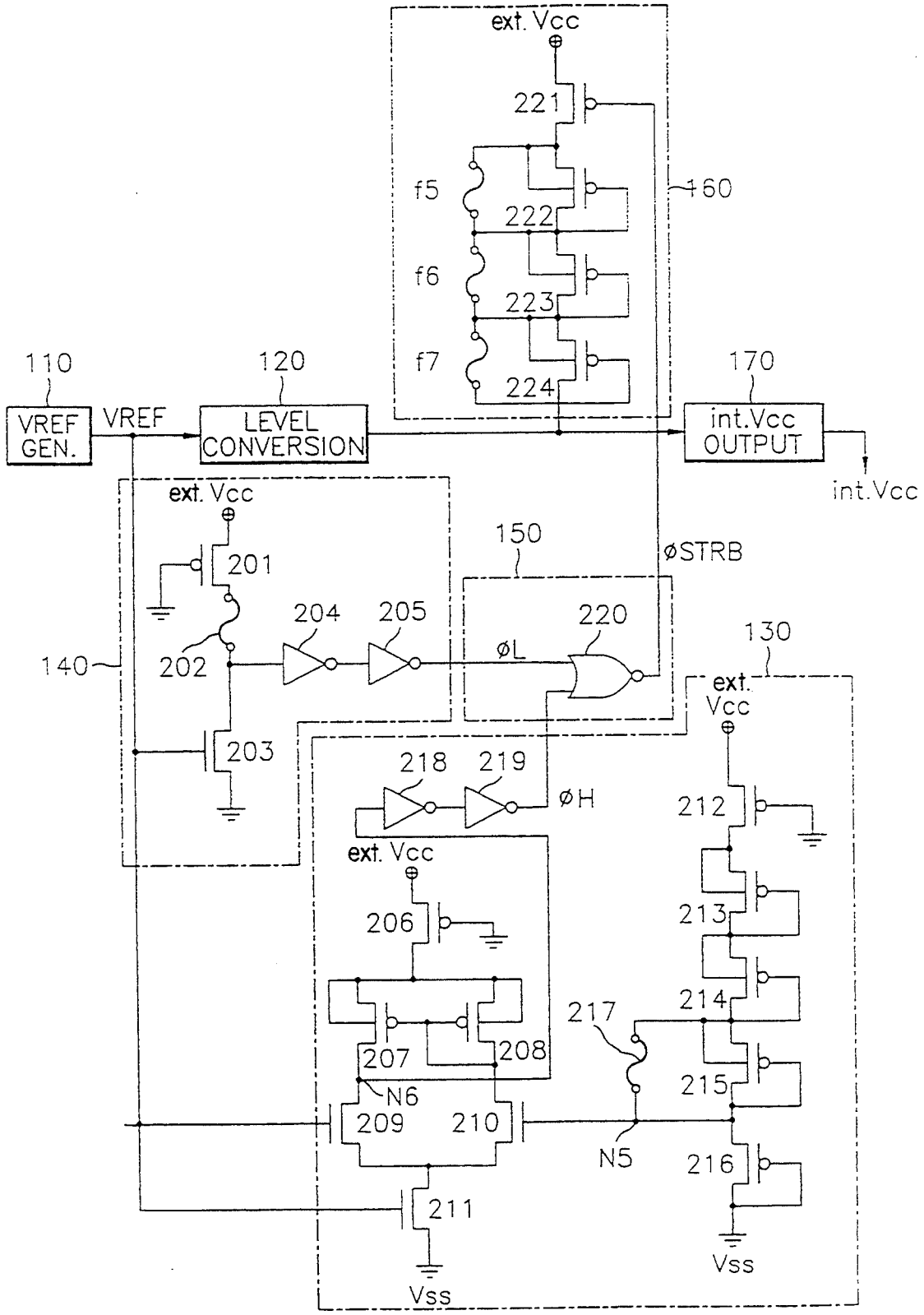
FIG. 6 is a detailed diagram of the internal supply voltage generation circuit of FIG. 5.
Figure 7:
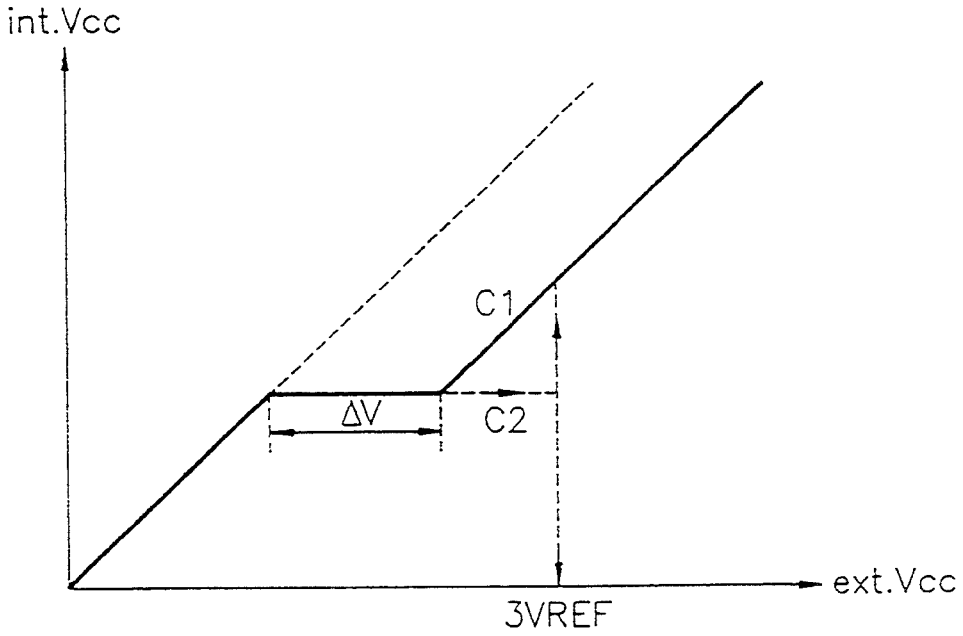
FIG. 7 shows the output voltage characteristic curve for the internal supply voltage generation circuit of FIG. 6.

FIG. 6 illustrates a exemplary detailed circuit of the internal supply voltage generation device of FIG. 5. FIG. 7 illustrates a characteristic output voltage curve for the circuit of FIG. 6.

As can be seen in FIG. 6, the burn-in voltage control means 160 includes diode-connected PMOS transistors 222–224 connected in series, and a PMOS transistor 221 connect between the external supply voltage ext.$V_{cc}$ and PMOS transistor 222. PMOS transistor 221 is controlled by the output of NOR gate 220 in the burn-in signal generation means 150. Fuses f5, f6, and f7 are connect in parallel with PMOS transistors 222, 223, and 224, respectively.

Burn-in setting means 140 includes fuse 202 for setting the device in a burn-in mode. In normal operation, fuse 202 is not opened, or cut-off. Under this condition, the output signal of the burn-in mode setting means 140, $\phi$L, is set to a logical "high" and the burn-in signal $\phi$STRB is set to a logical "low" Accordingly, the output characteristic of the internal supply voltage, int.$V_{cc}$, as seen in FIG. 7, is that of curve C1. In FIG. 7, voltage $\Delta V$ is variable from $|V_{tp}|$ to $3|V_{tp}|$ depending on the number of PMOS transistors cut-off by fuses f5–f7.

Alternatively, if fuse 202 is cut-off, the output signal $\phi$L is set to a logical "low" and the logic level of the burn-in signal $\phi$STRB is determined by the output signal $\phi$H of the external voltage detection means 130. The external voltage detection means 130 includes fuse 217 for controlling the burn-in voltage. If, for example, fuse 217 is not cut-off, the voltage at node N5 remains at a logical "low" level until ext.$V_{cc}$ rises to a level three time that of Vref (3Vref). In this voltage range, $\phi$H is "low" and $\phi$STRB is "high" so as to maintain a constant int.$V_{cc}$ with respect to the increasing ext.$V_{cc}$.

When ext.$V_{cc}$ increases to exceed 3Vref the voltage at node N5 becomes a logical "high", $\phi$H becomes "high" and $\phi$STRB becomes "low." These conditions enable the burn-in voltage control means 160, and, thus, allow the device to operate in burn-in mode. With fuse 217 not cut-off, the output characteristic for int.$V_{cc}$ can be expressed by the curve C2. With fuse 217 cut-off, the voltage at node N5 remains at a logical "low" until ext.$V_{cc}$ reaches four times the reference voltage, 4Vref.

Those of ordinary skill in the art will appreciate that the use of fuses within the burn-in voltage control means 160, the burn-in mode setting means 140, and the external voltage detection means 130 results in a device having a freely controllable burn-in voltage which can be easily varied without resort to expensive production changes. The foregoing preferred embodiments have been presented by way of example. Those of ordinary skill in the art will recognize that variations to these embodiments can be routinely made within the teachings of the foregoing examples. Such changes include, for example, substituting other switching elements, such as diodes, bipolar transistors, etc., for the diode-connect PMOS transistors of the preferred embodiments, or some other form of switching element for the fuses within the preferred embodiments. Such changes fall well within the scope of the claimed invention which has been described with recoarse to the preferred embodiments, but which is not limited to such.

What is claimed is:

1. An internal supply voltage generation device, receiving an external supply voltage and having a normal operation mode and a burn-in operation mode, comprising:

a reference voltage generator producing a reference voltage;

means for level converting said reference voltage;

external supply voltage detection means for receiving said reference voltage and for detecting a level of said external supply voltage;

burn-in mode setting means for receiving said reference signal and for setting said burn-in operation mode;

burn-in signal generation means, responsive to outputs from said external supply voltage detection means and said burn-in mode setting means, for generating a burn-in signal;

burn-in voltage control means, responsive to an output of said burn-in signal generation means, for controlling a voltage output level of said means for level converting; and, internal supply voltage output means coupled to outputs of said burn-in voltage control means and said means for level converting for generating an internal supply voltage during said normal operation mode, and said external supply voltage during said burn-in operation mode in accordance with said voltage output level of said means for level converting.

2. The internal supply voltage generation device of claim 1, wherein said burn-in mode setting means comprises a fuse which can be selectively severed to adjust a level of said burn-in signal.

3. The internal supply voltage generation device of claim 2, wherein said external supply voltage detection means, comprises:

a plurality of diode-connected MOS transistors connected in series between said external supply voltage and ground;

an output line connected to one of said plurality of MOS transistors; and, a fuse connected in parallel with at least one of said plurality of MOS transistors.

4. An internal supply voltage generation device, comprising:

a reference voltage generator for generating a reference voltage;

a level conversion circuit receiving said reference voltage, said level conversion circuit generating a level conversion output having a voltage level equal to an external supply voltage when said external supply voltage is below a first predetermined threshold, and having a voltage level equal to an internal supply voltage when said external supply voltage reaches said first predetermined threshold;

an external supply voltage detector coupled to said reference voltage for generating a detector output having a first logic level when said external supply voltage is below a second predetermined threshold, and a second logic level when said external supply voltage reaches said predetermined second threshold, said external supply voltage detector including a first fuse which can be selectively severed to adjust the level of said second predetermined threshold;

a burn-in mode setting circuit coupled to said reference voltage for producing a burn-in mode output which sets a burn-in mode, said burn-in mode setting circuit including a second fuse which can be selectively severed to adjust a level of said burn-in mode output;

a burn-in signal generator for generating a burn-in signal in in response to said detector output and said burn-in mode output;

a burn-in voltage control circuit for controlling said voltage level of said level conversion output in response to said burn-in signal; and, an internal supply voltage output circuit for selectively outputting said internal supply voltage or said external supply voltage, in accordance with said level conversion output.

5. The internal supply voltage generation device of claim 4, wherein said external supply voltage detector, comprises:

a plurality of diode-connected MOS transistors connected in series between said external supply voltage and ground;

an output line connected to one of said plurality of MOS transistors; and, said first fuse, connected in parallel with at least one of said plurality of MOS transistors.

6. The internal supply voltage generation device of claims 4, wherein said burn-in signal generator comprises a NOR gate receiving as inputs said burn-in mode output and said detector output.

7. The internal supply voltage generation device of claim 4, wherein said burn-in voltage control circuit comprises:

a MOS transistor connected to said external supply voltage, and responsive to said burn-in signal;

a plurality of diode-connected MOS transistors connected in series between said MOS transistor and said level conversion output; and, at least one third fuse connected in parallel with at least one of said plurality of diode-connected MOS transistors.

* * * * *